US008061789B2

(12) United States Patent
Krueger

(10) Patent No.: US 8,061,789 B2
(45) Date of Patent: Nov. 22, 2011

(54) STORAGE DEVICE WITH PIVOT ARM

(76) Inventor: Joseph Krueger, Solana Beach, CA (US)

( * ) Notice: Subject to any disclaimer, the term of this patent is extended or adjusted under 35 U.S.C. 154(b) by 283 days.

(21) Appl. No.: 12/534,713

(22) Filed: Aug. 3, 2009

(65) Prior Publication Data

US 2010/0140194 A1 Jun. 10, 2010

Related U.S. Application Data

(63) Continuation-in-part of application No. 10/216,479, filed on Aug. 9, 2002, now abandoned.

(51) Int. Cl.
*A47B 67/02* (2006.01)

(52) U.S. Cl. ..... 312/248; 312/319.7; 211/100; 211/116

(58) Field of Classification Search ..... 211/104, 211/99, 100, 116; 248/291.1, 240, 328, 329, 248/324; 312/248, 246, 319.7–319.8
See application file for complete search history.

(56) References Cited

U.S. PATENT DOCUMENTS

| | | | | | |
|---|---|---|---|---|---|
| 2,851,165 | A | * | 9/1958 | Schreyer et al. | 211/1.51 |
| 2,875,903 | A | * | 3/1959 | Shourds | 211/100 |
| 4,114,764 | A | * | 9/1978 | Rich | 211/100 |
| 4,915,461 | A | * | 4/1990 | Kingsborough et al. | 312/248 |
| 5,011,029 | A | * | 4/1991 | Sugasawara et al. | 211/104 |
| 5,067,621 | A | * | 11/1991 | Alexander | 211/117 |
| 5,108,063 | A | * | 4/1992 | Koerber et al. | 248/284.1 |
| 5,224,677 | A | * | 7/1993 | Close | 312/247 |
| 5,249,858 | A | * | 10/1993 | Nusser | 312/248 |
| 5,758,782 | A | * | 6/1998 | Rupert | 312/248 |
| 5,857,756 | A | * | 1/1999 | Fehre | 312/246 |
| 5,979,671 | A | * | 11/1999 | Pan et al. | 211/1.57 |

* cited by examiner

*Primary Examiner* — Hanh V Tran
(74) *Attorney, Agent, or Firm* — John R. Ross; John R. Ross, III

(57) ABSTRACT

A storage device. The storage device has at least one pivot arm that is pivotally mounted to a support frame. A storage rod is attached to the pivot arm(s). The pivot arm(s) control the movement of the storage rod between a conveniently accessible lower use position and an upper storage position. In a preferred embodiment the storage device is mounted inside a closet and is used in conjunction with storage drawers that rest on the floor. Also, in a preferred embodiment a linear actuator is connected to the pivot arm and controls the pivoting of the pivot arm.

16 Claims, 12 Drawing Sheets

Fig 6
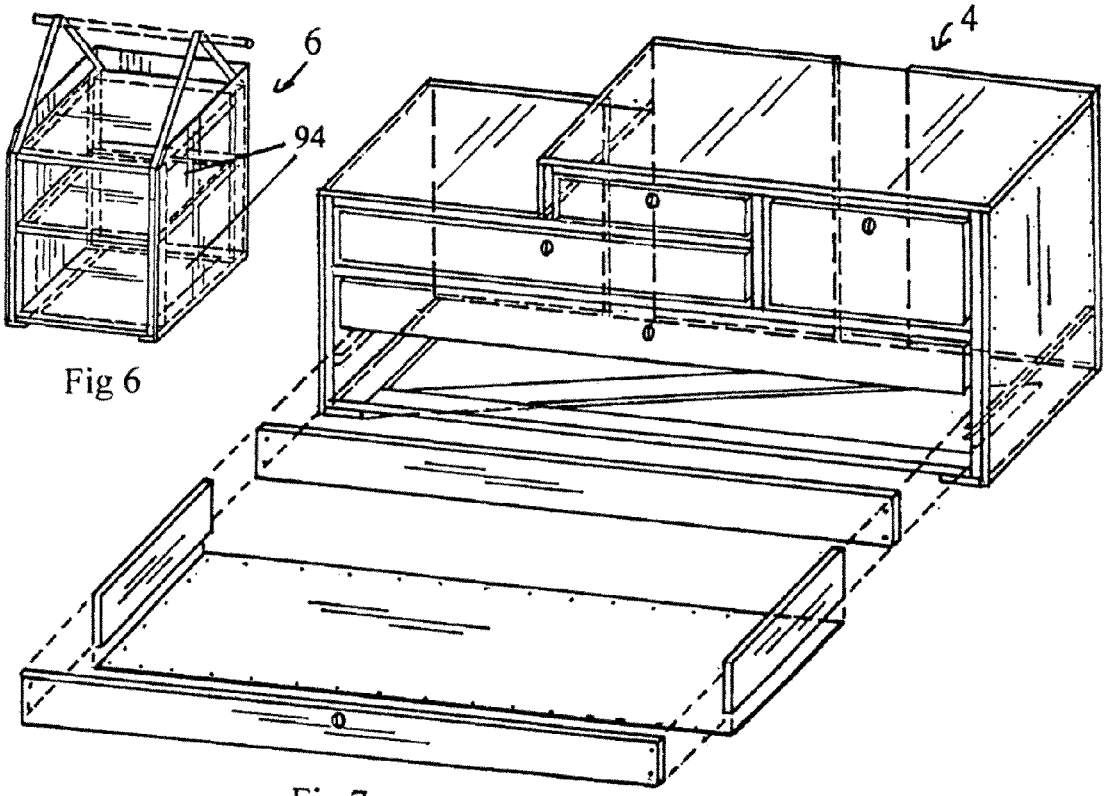
Fig 7
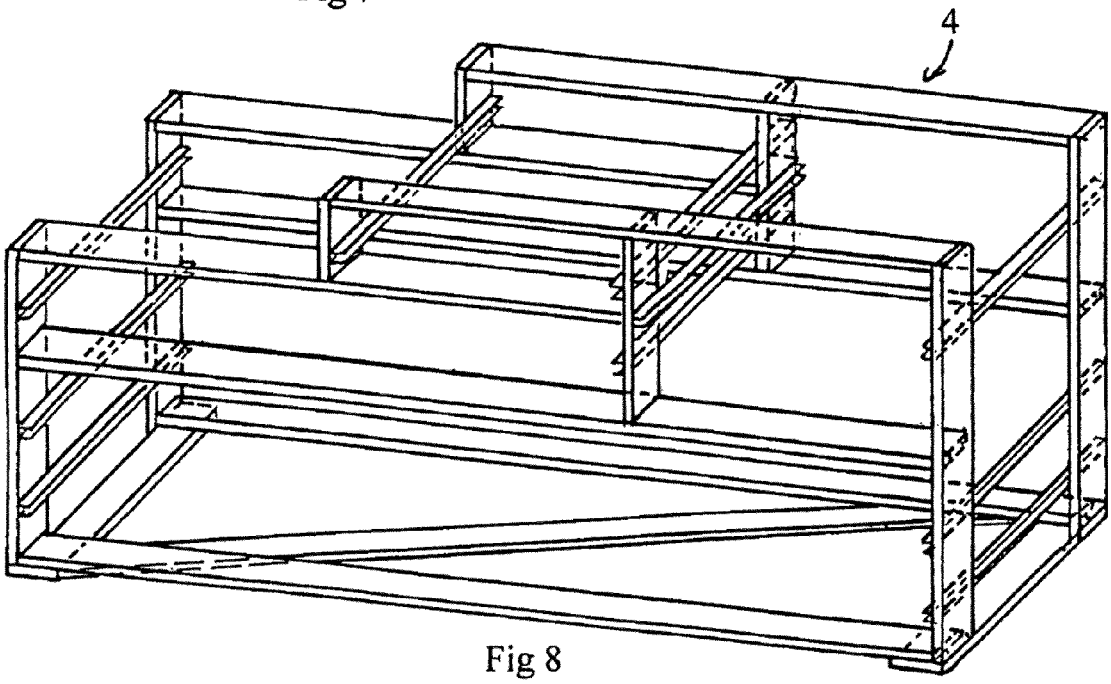
Fig 8

35
34A
41
68
70
74

24

30A
60
62
36
90
35
92
74
34A
70
91
71

45
38
68
76
76
60
30B
41
35
36
30A
62
74
34A
70

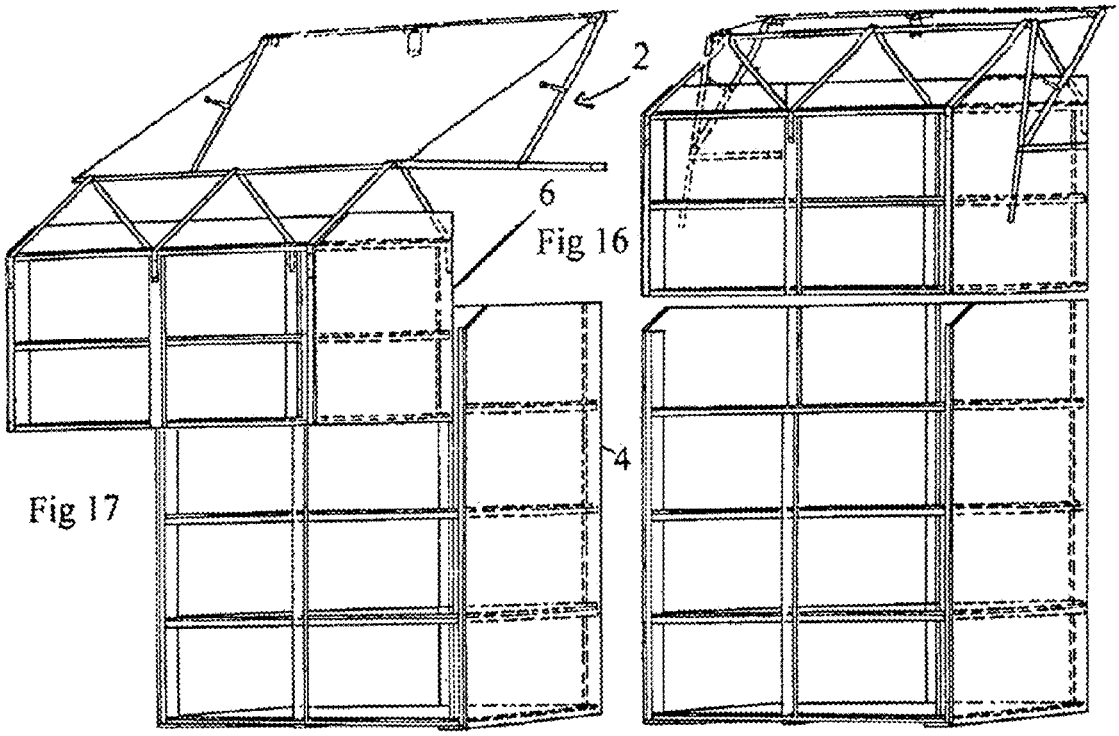
Fig 16
Fig 17
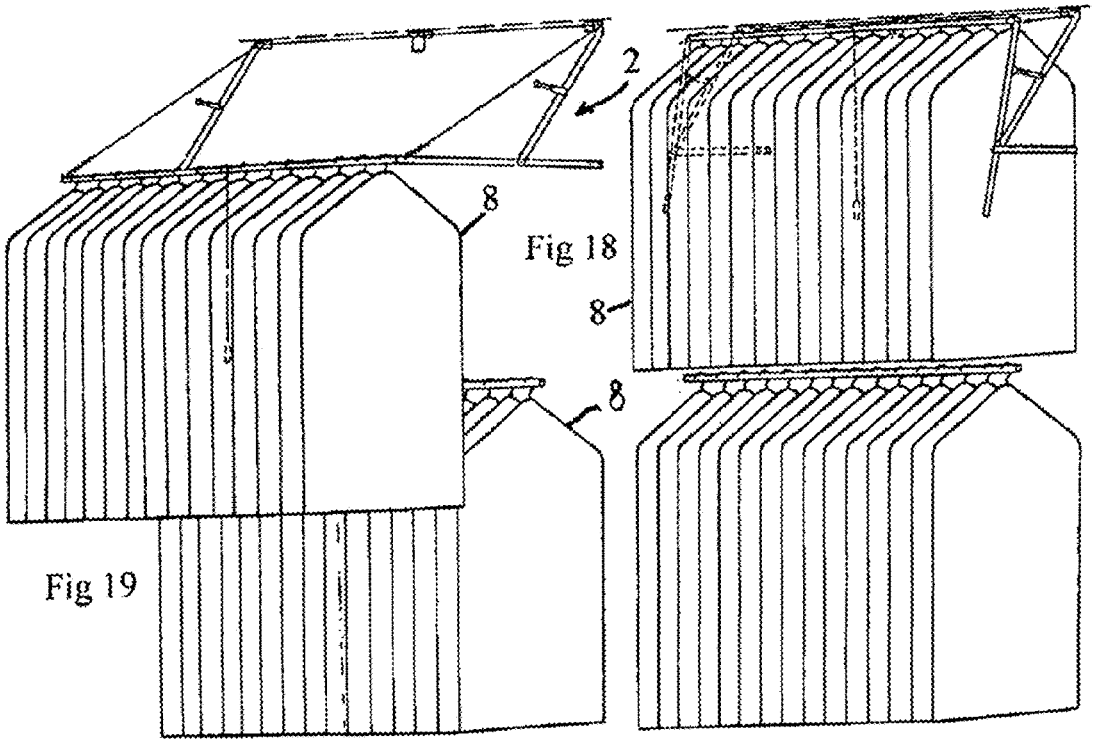
Fig 18
Fig 19

STORAGE DEVICE WITH PIVOT ARM

The present invention relates to storage devices, and in particular, to storage devices that provide for the placement and retrieval of storable items at convenient heights and also the storing of the storable items at higher heights. This application is a continuation-in-part application of U.S. patent application Ser. No. 10/216,479 filed Aug. 9, 2002 now abandoned, which is incorporated by reference herein.

BACKGROUND OF THE INVENTION

Maximizing the efficiency of closet storage capacity is a long sought after goal. Typically, the space above the storage rod and shelf of a home closet is underused. The one or two shelves usually provided are too high for convenient storing and retrieval of storable items.

Typical ceiling heights of 8 feet create an underused volume approaching approximately 20 percent of total closet storage capacity. Closets having greater ceiling heights have even a greater loss of storage capacity.

Users who are physically challenged or that are confined to a wheel chair have further challenges to reaching items stored high in a closet.

What is needed is a better closet storage device.

SUMMARY OF THE INVENTION

The present invention provides a storage device. The storage device has at least one pivot arm that is pivotally mounted to a support frame. A storage rod is attached to the pivot arm(s). The pivot arm(s) control the movement of the storage rod between a conveniently accessible lower use position and an upper storage position. In a preferred embodiment the storage device is mounted inside a closet and is used in conjunction with storage drawers that rest on the floor. Also, in a preferred embodiment a linear actuator is connected to the pivot arm and controls the pivoting of the pivot arm.

BRIEF DESCRIPTION OF THE DRAWINGS

FIG. 6 shows a hanging storage platform

FIGS. 7-8 show preferred storage drawers.

FIGS. 16-17 show another preferred embodiment of the present invention.

FIGS. 18-19 show another preferred embodiment of the present invention.

DETAILED DESCRIPTION OF THE PREFERRED EMBODIMENTS

Preferred embodiments of the present invention can be seen by reference to FIGS. 1-28.

First Preferred Embodiment

A first preferred embodiment of pivot storage device 2 is shown in detail in FIGS. 9 thru 12. In the first preferred embodiment pivot storage device 2 is installed in a typical household closet.

Figure 9:
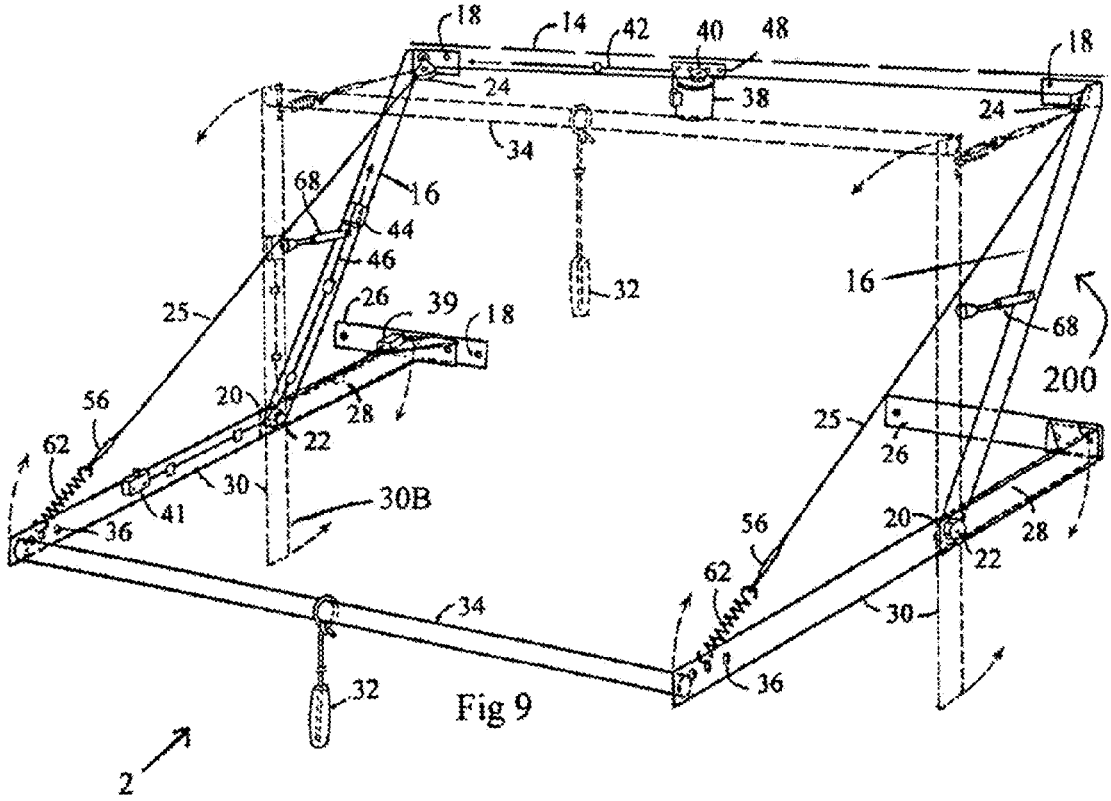
FIGS. 9-10, and 12 show another preferred embodiment of the present invention.
Figure 10:
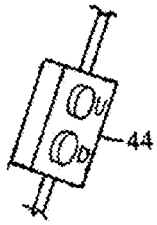

Rigidly mounted support frame 200 includes sloping struts 16 and horizontal struts 28, as shown in FIG. 9. Sloping struts 16 are attached via screws 18 to the rear wall of the closet below ceiling juncture 14. Pulleys 24 are attached to struts 16. Horizontal struts 28 are attached via screws 18 to bridge plate 26. Bridge plate 26 is attached via screws 18 to wall studs (not shown) behind the rear wall. Sloping struts 16 are connected to horizontal struts 28 via bolts 22.

Near one end, pivot arms 30 are pivotally connected at bolts 22 to sloping struts 16 and horizontal struts 28. At their other end, pivot arms 30 are connected to storage rod 34. Each pivot arm 30 has buffer spring holes 36.

Operating cord 32 is connected to storing rod 34. Operating cord allows the user to manually pull down storage rod 34.

Figure 12:
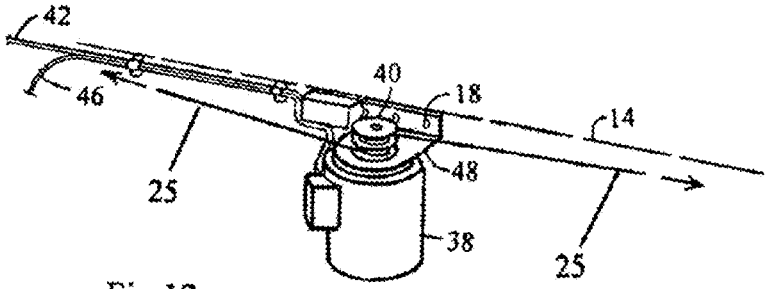
Figure 11:
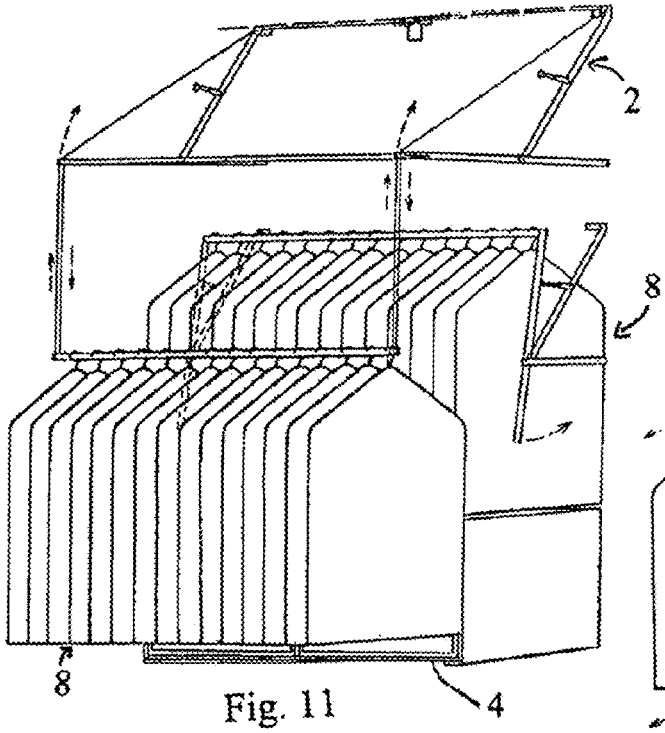
FIGS. 11, 14 and 15 show another preferred embodiment of the present invention.
Figure 14:
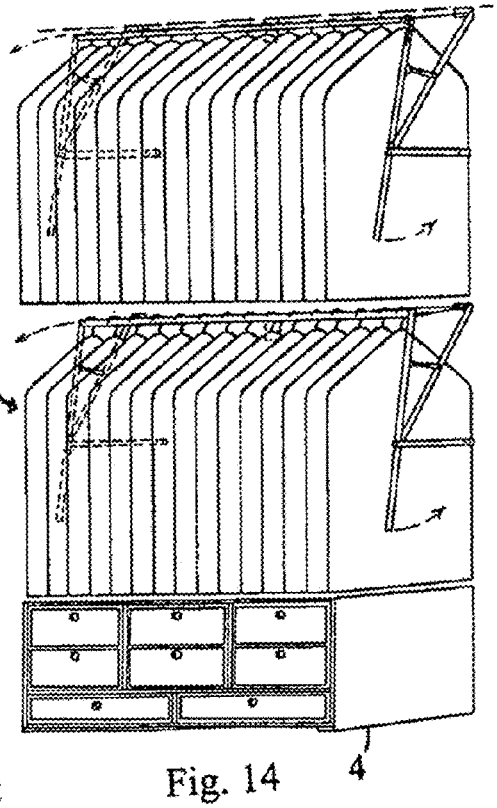
Figure 15:
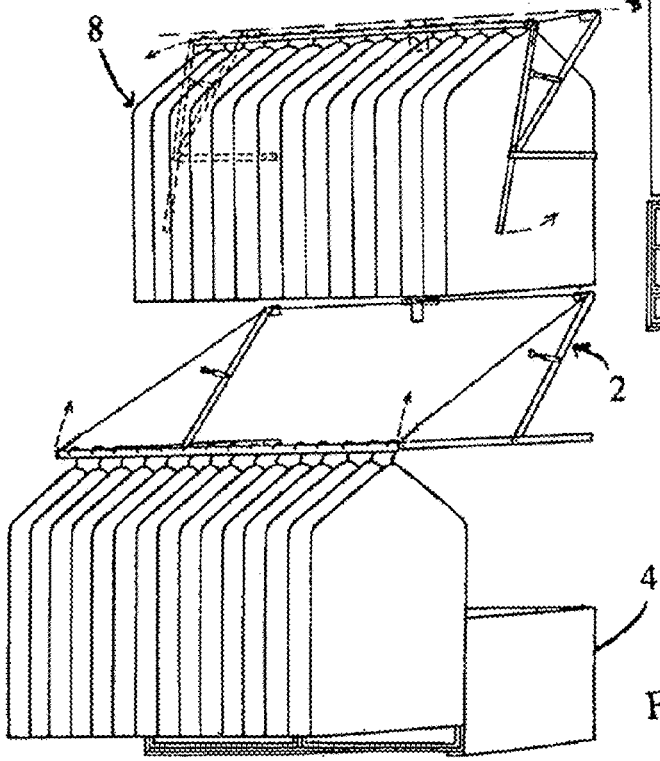

In the first preferred embodiment, storage rod 34 is raised and lowered with geared controllable electric motor 38 (see also FIG. 12). Motor 38 is attached to the rear wall via bracket 48. Electric power cord 42 is connected to an approved electric source, such as standard household electric current. Control cord 46 (FIG. 12) electrically connects controller 44, upper limit switch 41 and lower limit switch 39 to motor 38.

In the preferred embodiment, upper limit switch 41 contacts stop 68 and turns off power to motor 38 when storage rod 34 is in the upper storage position. Likewise, lower limit switch 39 contacts portion 30B of pivot arm 30 turning off power to motor 38 when storage rod 34 is in the lower use position.

Cables 25 are each attached to windlass pulley 40, as shown in FIG. 12. Windlass pulley 40 is rotated by geared controllable electric motor 38. The other ends of cables 25 are attached via buffer springs 62 to pivot arms 30. Motor 38 turns windlass pulley 40 so cables 25 move storage rod 34 between the upper storage position and the lower use position, as shown in FIG. 9.

When storage rod 34 is in the lower use position, pivot arm 30 is approximately horizontal. In the first preferred embodiment, storage rod 34 is approximately 5¾ feet from the floor when it is in the lower use position. It is therefore conveniently accessible to non-handicapped users. While it is at the lower use position, a user can easily access storage rod 34 for use. One example of the utilization of storage rod 34 would be the hanging of garments on storage rod 34.

The user can energize motor 38 to raise storage rod 34 so that it is in the upper storage position (shown in dotted line in FIG. 9). When storage rod 34 is in the upper storage position, pivot arm 30 is approximately vertical. In the first preferred embodiment, storage rod 34 is approximately 7¾ feet from the floor when in the upper storage position.

Second Preferred Embodiment

Figures 13A, 13B, 13C, 13D, 13E:
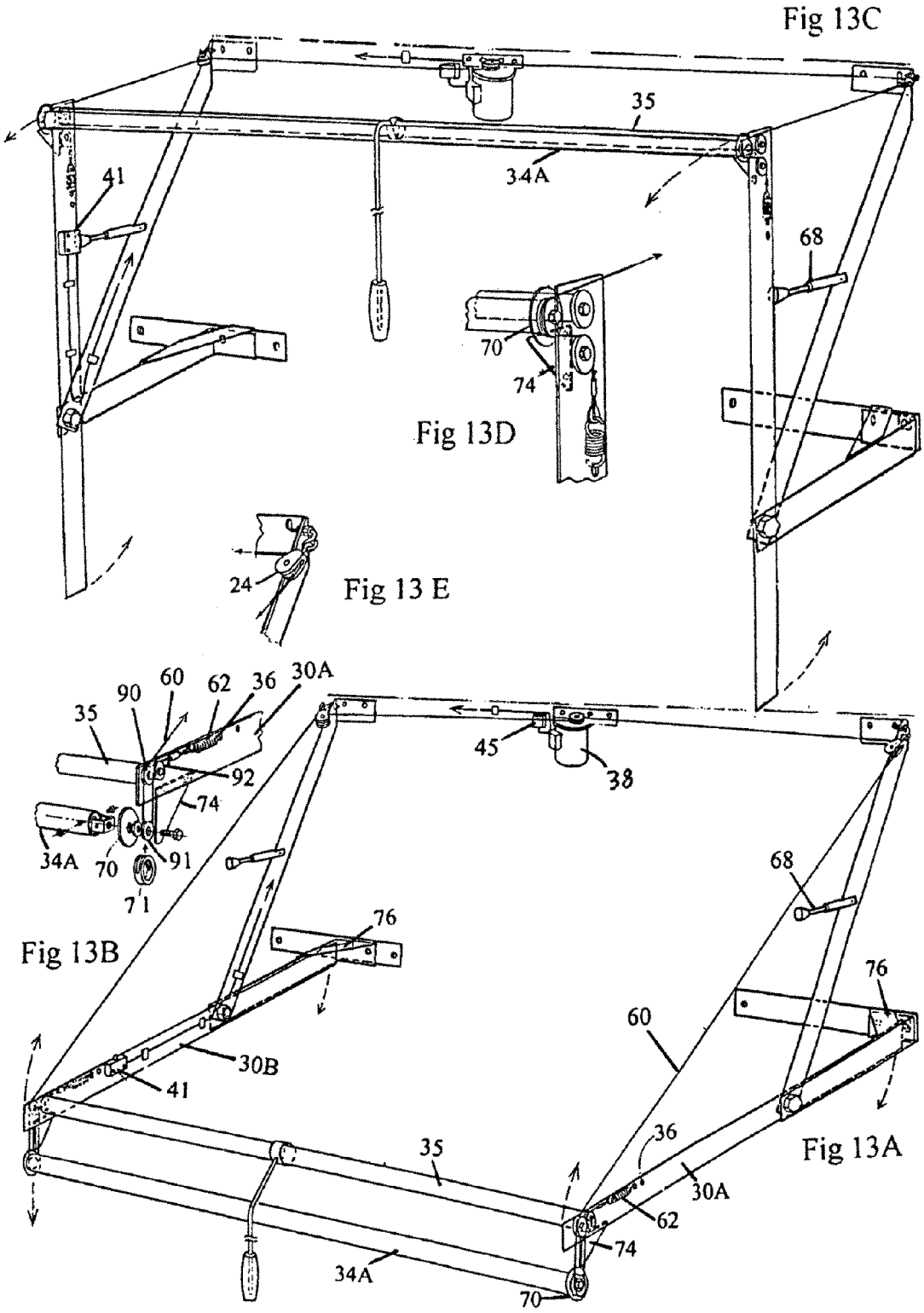
FIGS. 13A-13E show another preferred embodiment of the present invention.

A second preferred embodiment is shown in FIGS. 13A-13E. Lowerable storage rod 34A can be lowered downward from pivot arms 30A and 30B via cable 60. Lowerable storage rod 34A has one locking flange 70 attached to each of its ends. Pivot arms 30A and 30B have mating flange 74 formed at one end and holes 36 for receiving buffer spring 62 (FIG. 13B). Rod 35 is rigidly attached to pivot arms 30A and 30B. Cables 60 are appropriately lengthened to allow desired additional lowering of rod 34A.

As shown in FIG. 13B, cable 60 loops around pulley 90, pulley 91 and then pulley 92. The end of cable 60 is connected to buffer spring 62 which is attached to pivot arm 30A at buffer spring hole 36. Guide 71 helps prevent cable 60 from slipping off pulley 91. In the second preferred embodiment, for the purpose of adjustment, there are multiple spring buffer holes 36 each of which can accept buffer spring 62.

Raising from the Lower Use Position to the Upper Storage Position

Motor 38 when raising rod 34A from the position shown in FIG. 13A causes flange 70 to engage flange 74, causing proper alignment of lowerable storage rod 34A. After lowerable storage rod 34A is properly adjacent to and properly aligned with rod 35, the winding of cables 60 by motor 38 will raise pivot arms 30A and 30B in a fashion similar to that described above in the first preferred embodiment. Pivot arms 30A and 30B will continue raising until their movement is stopped by upper limit stops 68 (FIG. 13C).

Lowering from the Upper Storage Position to the Lower Use Position

Lowering pivot arm 30A from the position shown in FIG. 13C will continue until its downward motion is ended by stop 76 whereupon flanges 74 and 70 disengage. Motor 38 causes additional unwinding of lengthened cable 60, allowing lowerable storage rod 34A to additionally descend towards a lower pre-selected position (FIG. 13A). The user then releases the down switch on controller 44, stopping movement. In the second preferred embodiment, storage rod 34A can be lowered an additional 3 feet below the height of rod 35 so that storage rod 34A is approximately 2¾ feet above the floor. The second preferred embodiment is particularly useful to very short people or to handicapped users who may be confined to a wheelchair and unable to reach to the height of rod 35. The additional lowering feature of the third preferred embodiment assures physically challenged persons and handicapped persons (including persons in wheelchairs) convenient ready access to their storable items.

Third Preferred Embodiment

The third preferred embodiment combines pivot storage device 2 with storage drawers 4. Examples of various configurations of the fourth preferred embodiment are shown in FIGS. 1-5, 11, 14, and 15-17. Details of a preferred storage drawer 4 are shown in FIGS. 7 and 8. In each of the configurations shown, storable items (such as clothing 8) (FIGS. 1-5) are hung on pivot storage device 2 when it is in the lower use position. Then, pivot storage device 2 is pivoted upward by starting motor 38 (FIG. 9) in a manner described above. By utilization of the present invention, the user is able to store his clothing high up in the closet, taking advantage of storage space that has traditionally been unused. The combination of pivot storage device 2 with storage drawers 4 provides for efficient overall storage.

Fourth Preferred Embodiment

The fourth preferred embodiment utilizes hanging storage platform 6, shown in FIG. 6. Hanging platform 6 includes shelves 94 for supporting storable items. An example of hanging storage platform 6 being utilized is shown in FIGS. 16 and 17.

Fifth Preferred Embodiment

A fifth preferred embodiment is shown in FIGS. 20A-20E. In the fifth preferred embodiment, the user can approach either storage rod 34A or storage rod 34B from their sides by lowering only the desired storage rod. For example, in FIG. 20A the user lowers rod 34A for access to its stores while standing in space left available by raised storage rod 34B. This embodiment is useful for situations in which there is inadequate space to approach the storage rods from the front.

Figures 20A, 20B, 20C, 20D:
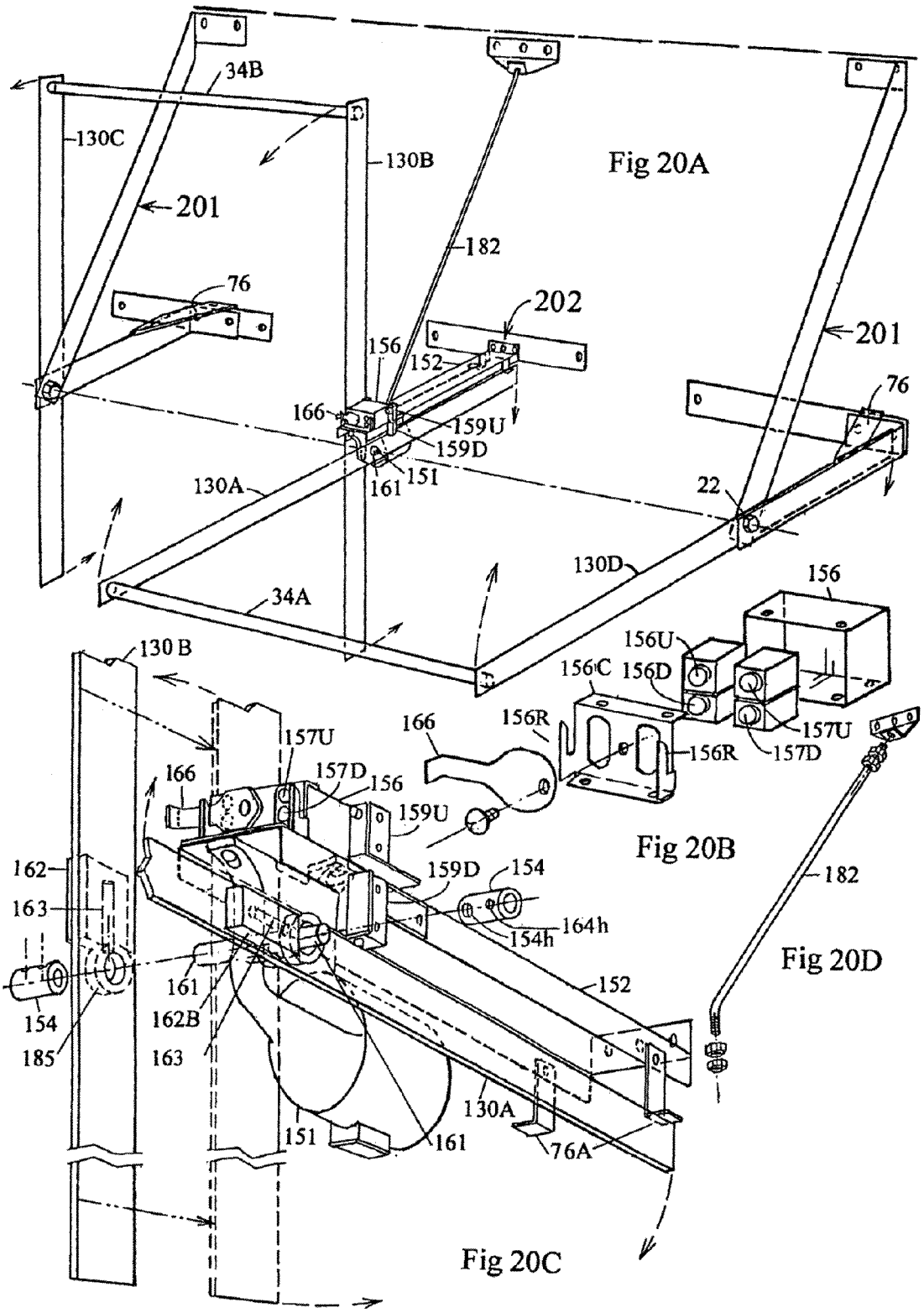
FIGS. 20A-20H show another preferred embodiment of the present invention.

FIG. 20A shows storage rod 34A in the lower use position, and rod 34B in the upper storage position. Two outer support frame sections 201 are installed. One inner support frame section 202 is installed. Attached to frame section 202 is motor bracket 152. Motor bracket 152 is further supported by support bracket 182 (see FIG. 20D).

Pivot arms 130A and 130B are attached to shaft 161 of motor 151 via boss 185 and shaft sleeve 154 (FIG. 20C). Motor 151 is attached to the underside of bracket 152. Motor 151 is positioned so shafts 161 are concentric about the same axis as pivot bolts 22 (FIG. 20A). Preferably motor 151 is a twin output shaft right angle drive gear motor.

Storage Rod Control

Limit Switches

Limit switches 159U and 159D are attached via a bracket to the right side of motor bracket 152 near control box 156, directly in the path of pivot arm 130A. Similar limit switches (not shown) are attached to the left side of bracket 152 near box 156 directly in the path of approaching arm 130B. Stops 76A are attached to each side of motor bracket 152 near inboard end of bracket 152 (FIGS. 20A and 20C).

Control Switches

Storage rods 34A and 34B are attached to pivot arms 130A and 130B, respectively. Pivot arms 130A and 130B are attached to motor shaft 161 of motor 151. Multi pole control switches 156U, 156D, 157U and 157D directly control motor 151 to raise or lower storage rods 34A and 34B. Switches 156U, 156D, 157U and 157D are contained in control box 156, which is mounted on the top side of motor bracket 152 above motor 151 (see FIGS. 20A and 20B). Box 156 has cover 156C, which is configured to expose switches 156U, 156D, 157U and 157D. Cover 156C also accommodates selector 166, and is further configured with retainer flanges 156R for engaging selector 166.

Upper Storage Position

Figure 20E:
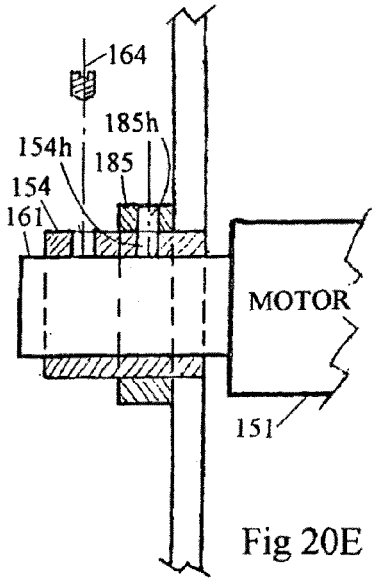
Figure 20F:
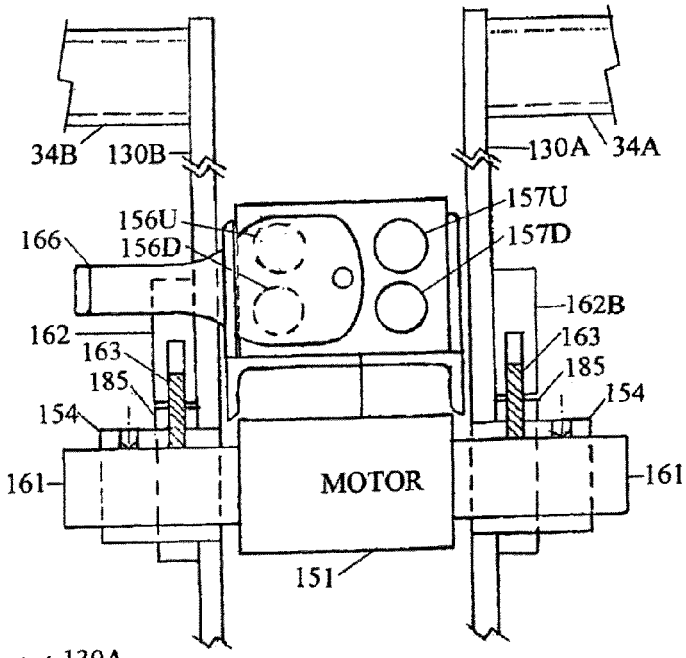
Figure 20G:
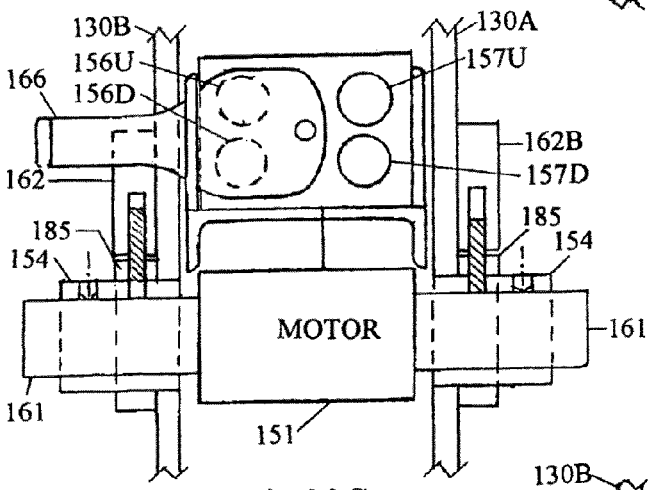
Figure 20H:
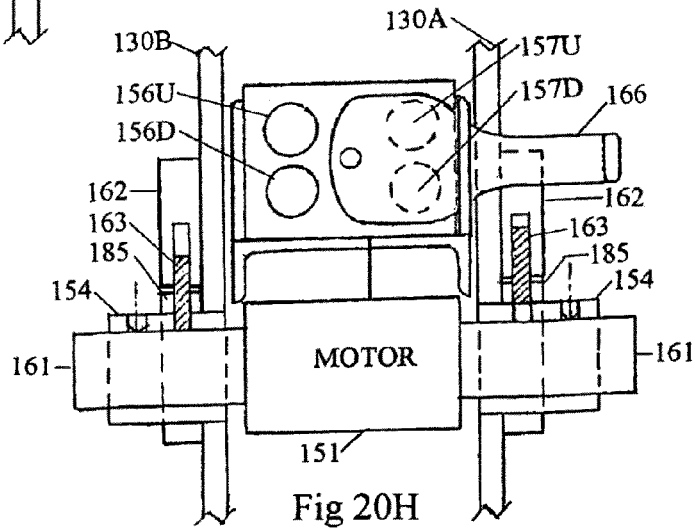

FIG. 20F shows both pivot arms 130A and 130B secure in the upper storage position. In this position coil spring assisted gravity maintains both solenoid pins 163 seated in shaft sleeve 154, through holes 185*h* and 154*h*. Holes 185*h* and 154*h* are shown in FIG. 20E. Both pins 163 rest on the periphery of shaft 161 of motor 151. Set screw 164 holds shaft sleeve 154 tight against shaft 161. In FIG. 20F, adjustable selector 166 is covering switches 156U and 156D and is blocking the pivoting of pivot arm 130B. Likewise, adjustable selector 166 can be repositioned to cover switches 157U and 157D and block the pivoting of pivot arm 130A, as shown in FIG. 20H.

Lowering a Storage Rod

To lower storage rod 34A (FIG. 20G), the user positions selector 166 to cover switches 156U and 156D and to block arm 130B. The user then depresses switch 157D to energize the electrical circuit that activates solenoid 162 on arm 130B. The pressing of switch 157 causes 1) solenoid pin 163 of solenoid 162 to withdraw from shaft sleeve 154 and 2) the starting of motor 151 in the forward direction. The starting of motor 151 causes the rotation of shaft 161 and the lowering of storage rod 34A. Pivot arm 130A ultimately contacts down limit switch 159D and stop 76A. This causes motor 151 to stop. Storage rod 34A is then in the lower use position shown in FIG. 20A.

Raising a Storage Rod

To raise storage rod 34A the user depresses switch 157U. This energizes the electrical circuit that maintains solenoid pin 163 of solenoid 162 withdrawn from sleeve 154 of blocked arm 130B. The depressing of switch 157U also causes motor 151 to start in the reverse direction to rotate pivot arm 130A so that storage rod 34A is raised to the position shown in FIG. 20G. Pivot arm 130A ultimately contacts limit switch 159U (FIG. 20C) stopping motor 151. Solenoid pin 163 of blocked arm 130B reseats into its shaft sleeve 154 through spring assisted gravity. Both arms are then secure in the upper storage position as shown in FIG. 20F.

Raising and Lowering the Other Storage Rod

To raise or lower storage rod 34B, selector 166 is repositioned as in FIG. 20H to expose control switches 156U and 156D and to unblock pivot arm 130B. Switches 157U and 157D and arm 130A are then blocked by selector 166. Newly exposed switches 156U and 156D are sequentially depressed as necessary, similar to the above description. Rod 34B responds similar to the description above for rod 34A.

The fifth preferred embodiment allows unique convenient side approach to stores, when inadequate frontal space prevents frontal approach to stores.

Sixth Preferred Embodiment

Figure 21A:
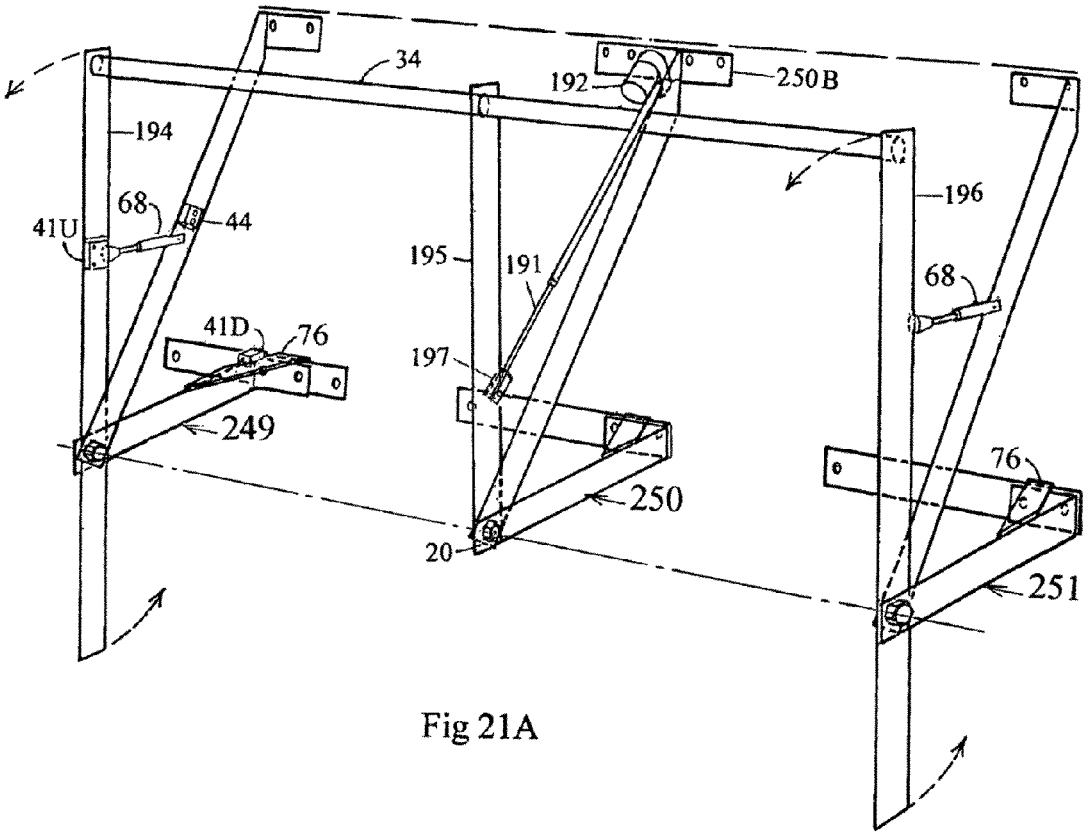
FIGS. 21A-21B show another preferred embodiment of the present invention.
Figure 21B:
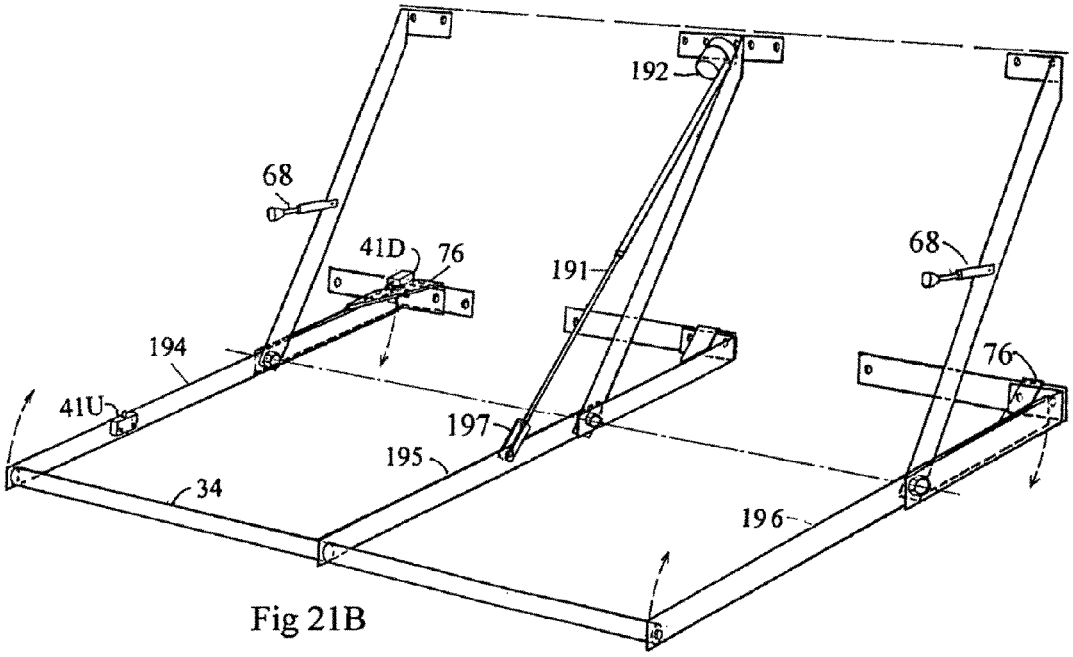

A sixth preferred embodiment is shown in FIGS. 21A and 21B. Pivot arms 194, 195 and 196 are pivotally attached to support frame sections 249, 250, and 251, respectively. Storage rod 134 is attached to the ends of pivot arms 194 and 196. Storage rod 134 passes through a hole at the end of pivot arm 195. Linear actuator 192 is attached at one end to upper support frame section 250B. Thrust rod 191 of linear actuator 192 is attached to pivot arm 195 via adjustable clevis 197.

Operation of the Sixth Preferred Embodiment

To lower storage rod 134, a user activates linear actuator 192 via control unit 44. Thrust rod 191 is then extended lowering pivot arms 194, 195 and 196 until storage rod 134 is in the lower use position shown in FIG. 21B. As shown in FIG. 21B, pivot arm 194 is in contact with lower limit switch 41D. Lower limit switch 41D is electrically connected to linear actuator 192. When pivot arm 194 contacts lower limit switch 41D, electricity to linear actuator 192 is interrupted deactivating linear actuator 192.

To raise storage rod 134, a user activates linear actuator 192 via control unit 44. Thrust rod 191 is then contracted, forcing the upward pivoting of pivot arms 194, 195 and 196 until storage rod 134 is in the upper storage position shown in FIG. 21A. As shown in FIG. 21A, stop 68 is in contact with upper limit switch 41U. Upper limit switch 41U is electrically connected to linear actuator 192. When stop 68 contacts upper limit switch 41U, electricity to linear actuator 192 is interrupted deactivating linear actuator 192.

Seventh Preferred Embodiment

A seventh preferred embodiment is shown in FIGS. 22-26. Support frame 201 and 201A are rigidly attached to mounting panel 202. Preferably, the top of support frame 201 is positioned about 8 feet above floor level of closet or other location. Panel 202 is rigidly attached to location's wall, or its supports (not shown). Pivot arms 203 are pivotally attached to support frames 201. Powered pivot arm 205 is pivotally attached to support frame 201A. Storage rod 204 is attached to pivot arms 203 and 205. Thrust tube 206 has its lower end pivotally attached to powered pivot arm 205, and its upper end threaded onto bottom end of threaded rod 206B. Threaded rod's upper end is factory installed into gears of motor 207. Energized motor 207 rotates threaded rod 206B. The rotation direction of threaded rod 206B causes thrust tube 206 to extend or retract which pivots pivot arm 205 to move storing rod 204 down or up. Motor 207 also contains a range of motion control, which user can preset to stop motor 207, which also stops attached storing rod 204, at any one of devices' many varying use positions, pre-selected by user, to fit user's special needs. For example, a handicapped user may need extra lowered use position, to conveniently access storing rod's stores. Specifically, a user depresses "down" button 208B on control 208 which energizes motor 207 to rotate rod 206B to extend thrust tube 206, which pivots arm 205 which lowers storage rod 204 outward and downward, then stopped by user preset range of motion control, de-energizing motor at user's pre-selected, one of many, variable use positions, including extra lowered use positions where stores are conveniently accessible to handicapped users. Likewise, user depresses "up" button 208A, on control 208 which energizes motor 207 to rotate rod 206B to retract thrust tube 206, which pivots arm 205, which raises storage rod 204 upward and inward, to stop at device's store position, by user preset range of motion control de-energizing motor 207.

Figure 22:
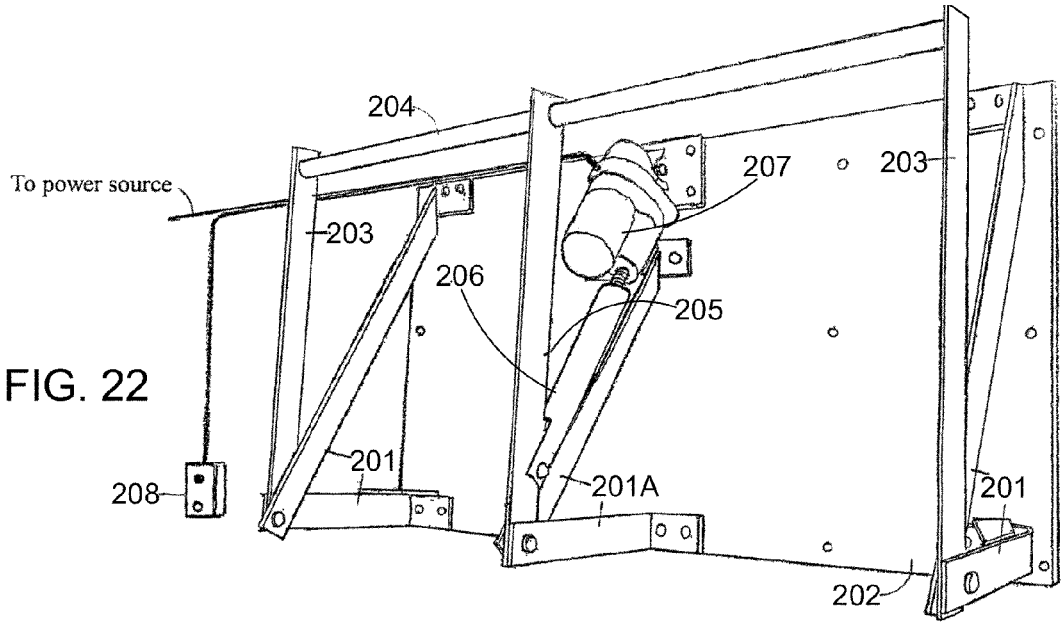
FIGS. 22-26 show another preferred embodiment of the present invention.
Figure 23:
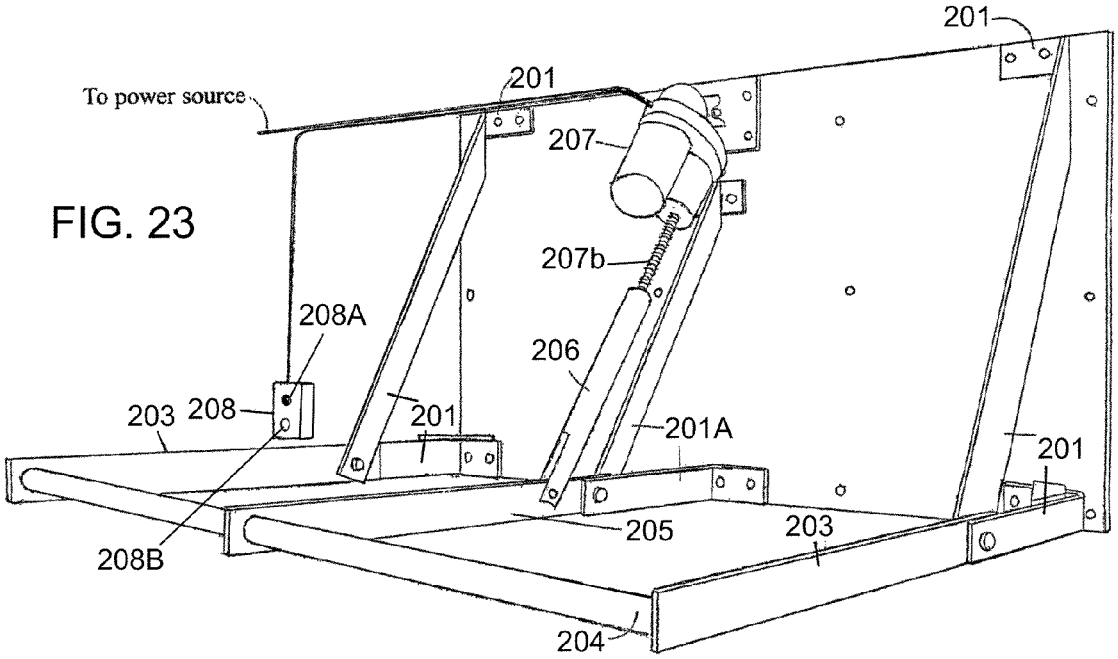
Figure 24:
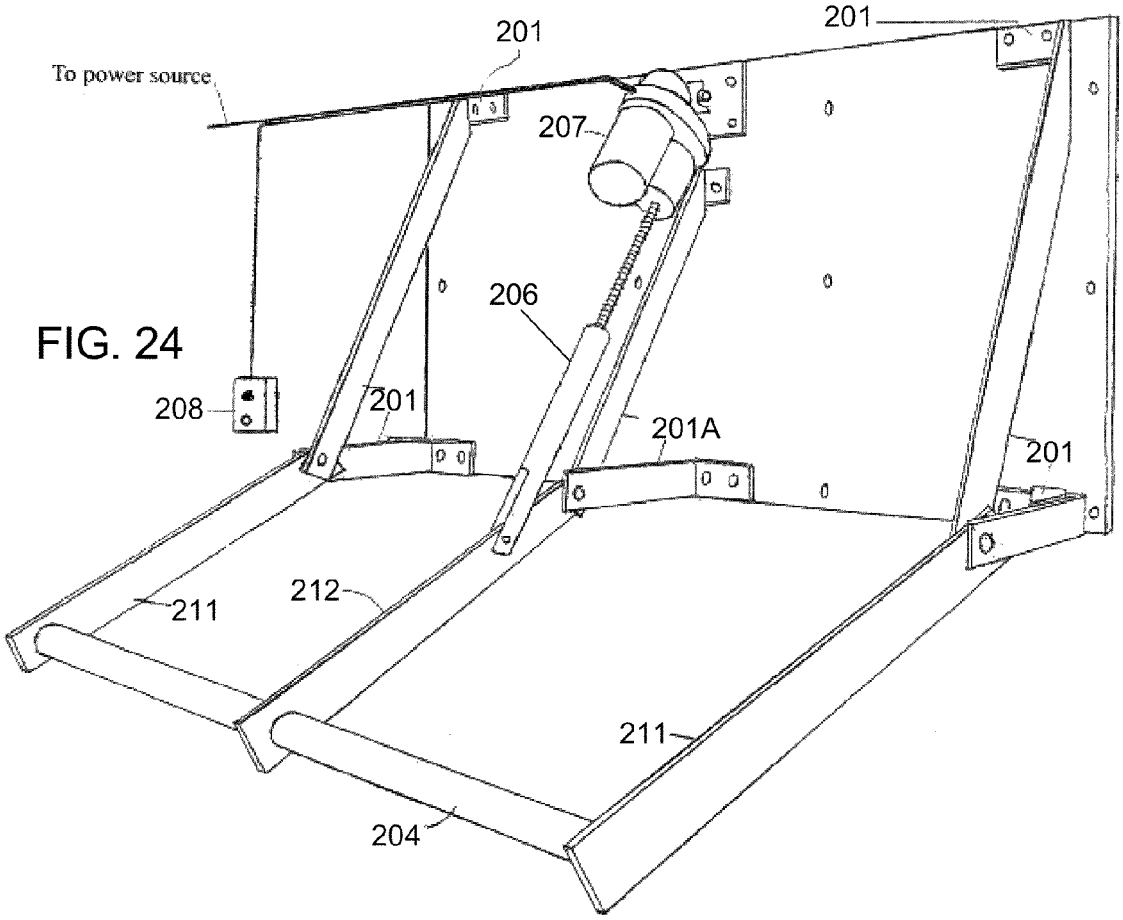
Figure 25:
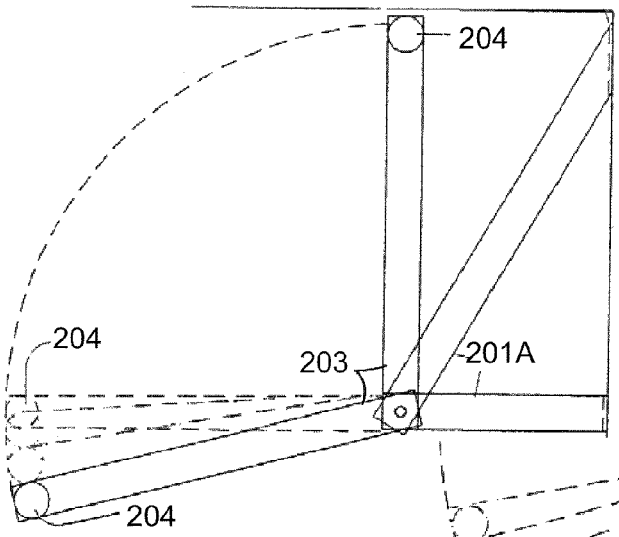
Figure 26:
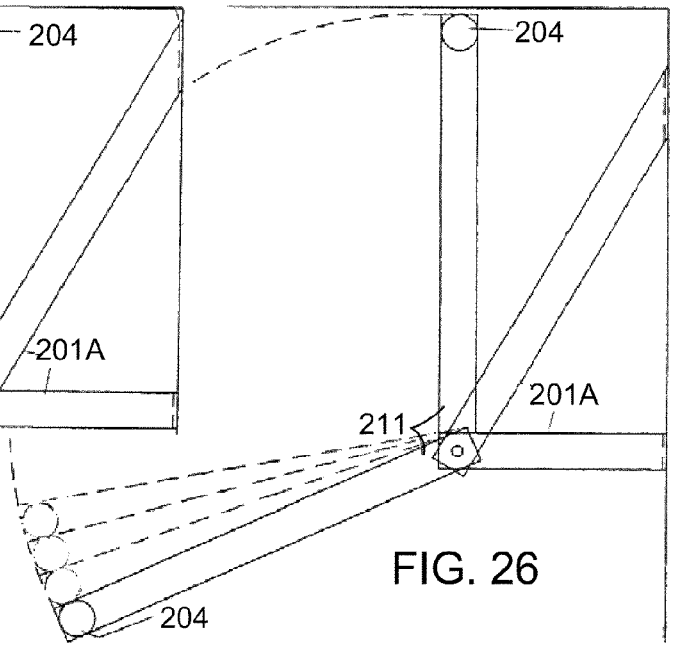

FIGS. 22, 23, and 25 show the device with inherent further lowering capability of stores. FIG. 25 shows inherent lowering capability ends about 57 inches above floor. This device, without change or extra cost assures users with some handicap, convenient access to their stores. FIGS. 24 and 26 shows device adjusted, to make a lower use position of about 50 inches above floor, making stores conveniently accessible at lower level, for users that are more handicapped, or in wheelchairs. Further device adjusting makes even further lowered (as much as needed) use positions possible for severely handicapped and wheelchair users. Unique extra lowering derives from device adjustment (i.e., horizontal legs of brackets 201 are lengthened, moving its pivot points. All pivot arms are lengthened, requiring a lowered device installation.) Tests show that combinations of these adjustments enable the device to replicate use positions shown in FIG. 26, and even lower use positions, via more adjusting, to make stores conveniently accessible to all users, including wheelchair users. The user can create desired use positions by presetting range of motion control to lowest use position, then press and hold "down" button for desired use position. FIG. 22 shows the seventh preferred embodiment with storage rod 204 about 8 feet above floor. Short stores or garments hung from 8 feet high storage rod, occupy about first 3 feet of high inconvenient space under rod 204. Remaining 5 feet of space continues to floor and is all conveniently accessible space vacated and available for additional stores.

Figure 2:
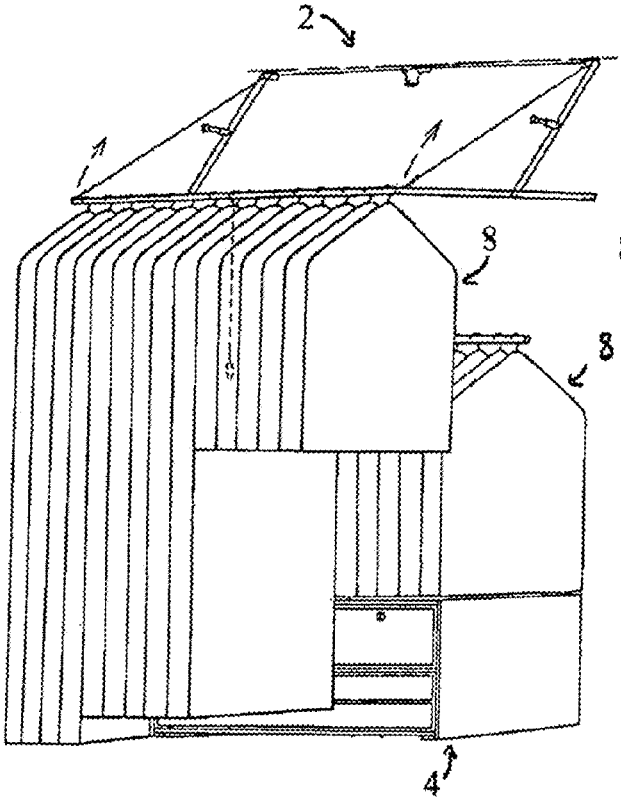
FIGS. 1-2 show a preferred embodiment of the present invention.
Figure 1:
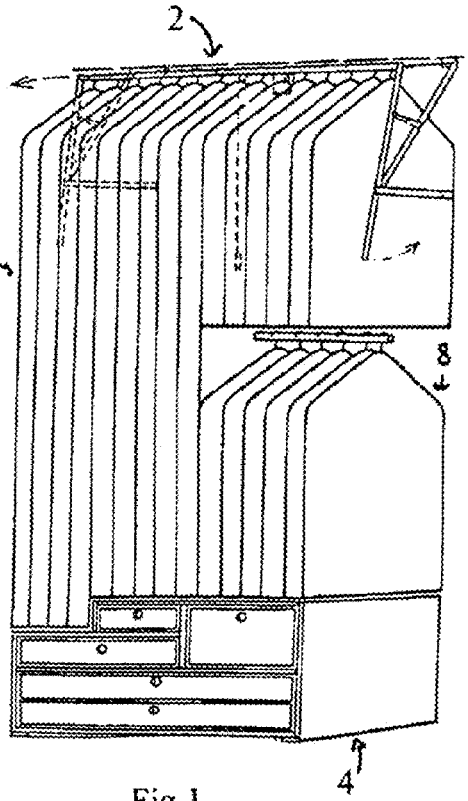
Figure 4:
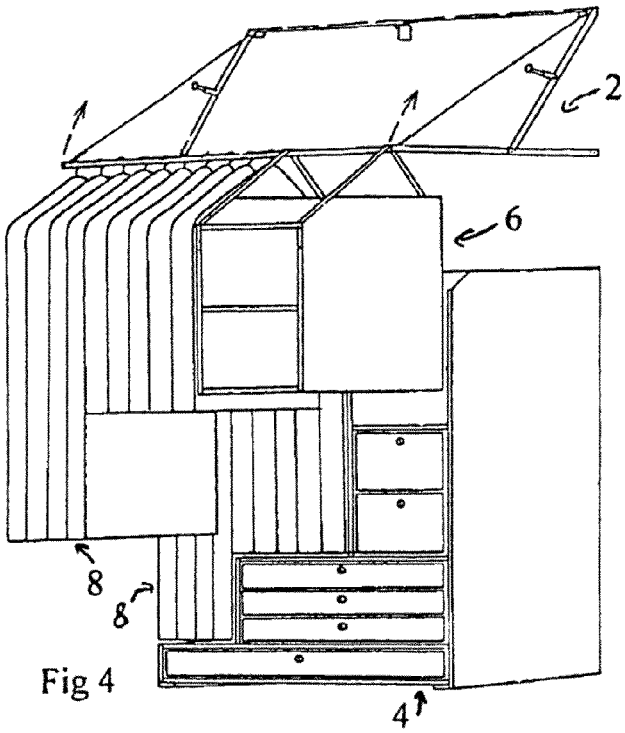
FIGS. 3-5 show another preferred embodiment of the present invention.
Figure 3:
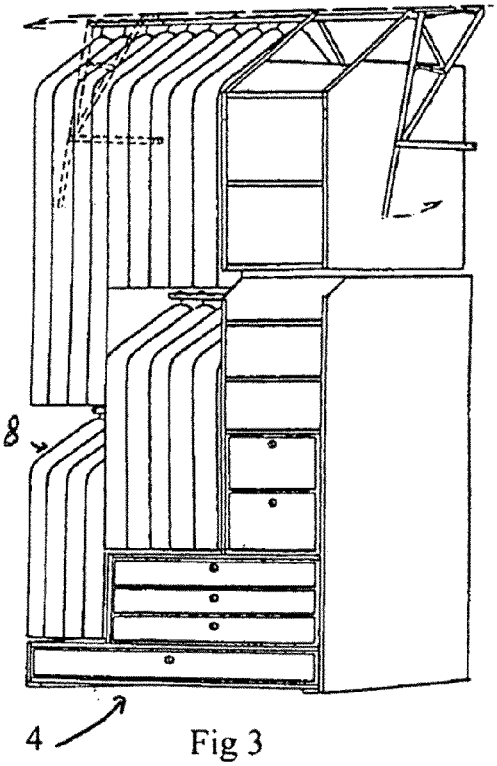
Figure 5:
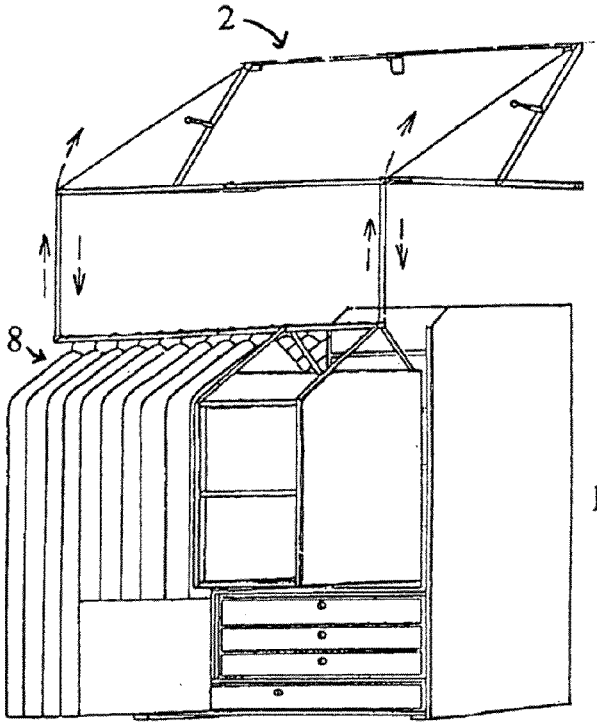

FIG. 1 shows this convenient space used for an additional tier of short stores and drawers on floor easily customized for stores including shoes or purses, which heretofore had inconveniently cluttered top shelves. Device fully uses vacated high inconvenient space to store, and then lowers stores are made conveniently accessible. Uniquely, space is fully used, all stores are made conveniently accessible.

Conveniently Accessible

Conveniently accessible is not the same for all users of this device. The device is adaptable to varying degrees of user purpose and capability. For example: "A" for younger robust, and physically fully capable, and "B" for older not physically capable or in wheel chairs, and "C" for all other potential uses. This device can adjust to serve equally this entire group of users. For users "A" above and the somewhat less capable, the arrangements shown in FIGS. 22 and 23 are suggested. For users "B" above, the arrangements shown in FIGS. 24, 25, and 26 are suggested.

User Capability A

FIGS. 22 and 23, when installed as above described, all provide a use position of storing rod 204 that is about 63 inches above floor of selected location. The traditional typical home closet rod is close to this height, and traditionally satisfactory as conveniently accessible to all the "A" users above.

User Capability B

Device in FIG. 23 installed as herein described provides a lowered use position of storing rod 204, shown in FIG. 25. The further lowering shown in FIG. 25 is inherently available in FIG. 23, by continued lowering of storing rod 204. The further lowering stops clear of other low stores. This no extra cost further lowering, serves users "B" that are only somewhat handicapped. FIGS. 24, and 26 installed as herein described can provide a use position of storing rod 204 that is variable and as low as 50 inches above the floor wherein even further lowering is possible for all those users "B" above, severely handicapped, with very limited reach, or in a wheel chair. Conclusively device provides convenient access to all stores, for all users, as it synergistically uses all available storage space plus all stores are made conveniently accessible.

User Capability C

It should be noted that the present invention can be adapted to work in a variety of locations other than just closets (i.e., factories, warehouses, etc.). Users in these other areas will benefit by the flexibility offered by increased upper storage and the multiple lower use positions, including the special needs of user in capability C, enabling them to best manage their wide variety of differing stores.

Although the above-preferred embodiments have been described with specificity, persons skilled in this art will recognize that many changes to the specific procedures disclosed above could be made without departing from the spirit of the invention. For example, although the above embodiments discussed the utilization of the present invention in conjunction with closets, it could also be placed in other areas in which it is important to maximize storage efficiency. For example, it could be placed in a mercantile or warehousing environment. Also, although the sixth preferred embodiment discussed the utilization of limit switches to deactivate linear actuator 192, it also possible to utilize a linear actuator that will deactivate automatically once the motion of thrust rod 191 is stopped via either stop 76 or stop 68 (FIGS. 21A-21B). Also, in place of support frame mounted control unit 44, it would also be possible to control motors 38 and 151 and linear actuator 192 via a wireless remote control unit. For example, it would be possible to utilize an infrared remote control unit or an RF remote control unit. Also, although the above preferred embodiments mentioned preferred heights for mounting the present invention, the present invention could be mounted at a variety of heights. Also, although it was stated in the second preferred embodiment that storage rod 34A can be lowered an additional 3 feet below the height of rod 35, the second preferred embodiment can be adjusted so that storage rod 34A can be lowered to a variety of different levels. Therefore, the scope of the invention is to be determined by the appended claims and their legal equivalents.

What is claimed is:

1. A storage device defining several lower use positions and an upper storage position, said storage device comprising:

A) a support frame,

B) at least one non-powered pivot arm, pivotally attached to said support frame at a first end, C) at least one powered pivot arm, pivotally attached to said support frame at a first end, D) a storage rod attached to a second end of said at least one non-powered pivot arm and said at least one powered pivot arm, E) a thrust rod or thrust tube pivotally connected to said at least one powered pivot arm, wherein actuation of said thrust rod or thrust tube causes the pivoting of said at least one powered pivot arm, and F) a linear actuator motor for powering said thrust rod or thrust tube, G) a selector switch to enable a user to control said linear actuator motor, wherein said at least one non-powered pivot arm and said at least one powered pivot arm are attached to said support frame at substantially the same elevation, said storage rod is moved from said upper storage position to a preferred lower use position, wherein said preferred lower use position is chosen from a plurality of said several lower use positions available to the user.

2. The storage device as in claim 1, wherein said support frame is rigidly mounted to the inside of a closet.

3. The storage device as in claim 1, wherein said support frame is rigidly mounted to the inside of a storage place.

4. The storage device as in claim 2, wherein said closet comprises a floor, wherein said storage device further comprises storage drawers resting below said storage rod on said floor in a space made available by said storage rod raising stores into said upper storage position.

5. The storage device as in claim 2, wherein said storage space comprises a floor, wherein said storage device further comprises storage drawers resting below said storage rod on said floor in a space made available by said storage rod raising stores into said upper storage position.

6. The storage device as in claim 1, further comprising at least one hanging storage platform hanging from said storage rod.

7. The storage device as in claim 1, wherein said selector switch comprises components for selecting up or down movement of said storage rod and energizing said linear actuator motor, and further comprising:

A) a range of motion controller that can be preset to control stopping said storage rod at a pre-selected lower use position.

8. The storage device as in claim 1, wherein said at least one non-powered pivot arm is two non-powered pivot arms.

9. The storage device as in claim 1, wherein said storage rod comprises a cross section area of sufficient size to adequately support stores or a clothes hanger for the hanging of garments.

10. The storage device as in claim 9 further comprising a clothes hanger hanging from said storage rod.

11. The storage device as in claim 1 further comprising a range of motion controller for controlling stopping said storage rod at pre-selected storage or use positions.

12. The storage rod as in claim 1 wherein said at least one non-powered pivot arm is two non-powered pivot arms connected to each end of said storage rod and wherein said at least one powered pivot arm is connected to the longitudinal center of said storage rod.

13. The storage rod as in claim 1, wherein said storage rod also stops at one of said several lower use positions when a user removes pressure from said selector switch.

14. The storage rod as in claim 1, further comprising a range of motion controller, wherein said range of motion controller is programmed to stop the motion of said storage rod at a predetermined preferred height.

15. The storage rod as in claim 1, wherein said at least one non-powered pivot arm and said at least one powered pivot arm are lengthened to enable decreasing the height above floor of said several lower use positions.

16. A storage device defining several lower use positions and an upper storage position, said storage device comprising:

A) a support frame,

B) at least one pivot arm, pivotally attached to said support frame at a first end, C) a storage rod attached to a second end of said at least one pivot arm, wherein stores are hung from said storage rod, D) a powered pivot arm, pivotally attached to said support frame at a first end and comprising a thrust tube having an outboard end pivotally attached to said powered pivot arm, said storage rod attached to a second end of said powered pivot arm, E) a linear actuator with motor comprising a range of motion control for stopping said thrust tube, F) a threaded rod engaged with said motor and attached to said thrust tube, and G) a selector switch, wherein said at least one non-powered pivot arm and said powered pivot arm are attached to said support frame at substantially the same elevation, and wherein depressing said selector switch "down" energizes said motor which rotates said threaded rod which converts its rotation into linear motion of attached thrust tube which causes said powered pivot arm to pivot, which pivoting causes outward and downward motion of said storage rod, wherein said range of motion control of said motor is preset to stop downward linear motion of said thrust tube when said storage rod reaches and is stopped in a use position suitable for fully capable users, and users somewhat handicapped, wherein said range of motion control can be alternatively set to stop linear motion of said thrust tube at any one of several possible lower use positions so that handicapped users with increased limitations will have a lowered use position that will provide convenient access to their stores including users in above mentioned capability who may require unusually different use positions in order to properly manage their widely varying stores, wherein even further lowered use positions are achieved by additional lengthening of said storage rod's pivot arms, and/or repositioning said pivot arm's pivot points wherein further lowered use positions are alternatively achieved to enable severely handicapped and wheel chair users to conveniently access their stores, wherein depressing said selector switch "up" energizes said motor which rotates said threaded rod which converts its rotation into linear motion of attached thrust tube which causes said powered pivot arm to pivot, which pivoting causes upward and inward motion of said storage rod, wherein said range of motion control of said motor is preset to stop the upward linear motion of said thrust tube when said storage rod reaches an upper store position, wherein moving stores upward vacates equivalent convenient space below for additional stores wherein all stores are made conveniently accessible.

* * * * *